US009835337B2

(12) United States Patent
Yeh et al.

(10) Patent No.: US 9,835,337 B2
(45) Date of Patent: Dec. 5, 2017

(54) GAS FIREPLACE

(71) Applicant: BAHUTONG ENTERPRISE LIMITED COMPANY, Taichung (TW)

(72) Inventors: Yen-Jen Yeh, Taichung (TW); Kuan-Chou Lin, Taichung (TW); Wei-Long Chen, Taichung (TW)

(73) Assignee: BAHUTONG ENTERPRISE LIMITED COMPANY, Taichung (TW)

( * ) Notice: Subject to any disclaimer, the term of this patent is extended or adjusted under 35 U.S.C. 154(b) by 83 days.

(21) Appl. No.: 14/961,577

(22) Filed: Dec. 7, 2015

(65) Prior Publication Data

US 2017/0009997 A1 Jan. 12, 2017

(30) Foreign Application Priority Data

Jul. 9, 2015 (TW) ..... 104122334 A

(51) Int. Cl.

| | |
|---|---|
| ***F24B 1/18*** | (2006.01) |
| ***F24C 3/02*** | (2006.01) |
| ***F24C 3/00*** | (2006.01) |
| *F24C 3/08* | (2006.01) |

(52) U.S. Cl.

CPC ..... *F24C 3/022* (2013.01); *F24C 3/006* (2013.01); *F24C 3/082* (2013.01)

(58) Field of Classification Search

CPC ..... F24C 3/006; F24B 1/1808
USPC ..... 126/512, 521
See application file for complete search history.

(56) References Cited

U.S. PATENT DOCUMENTS 3,995,611 A * 12/1976 Nelson ..... F24B 1/1886 126/521
2002/0056447 A1* 5/2002 Fogliani ..... F23D 14/105 126/512

* cited by examiner

*Primary Examiner* — Avinash Savani
(74) *Attorney, Agent, or Firm* — Lynette Wylie; Apex Juris, pllc.

(57) ABSTRACT

A gas fireplace includes a furnace, a burner, and an air guiding device, wherein the air guiding device divides an inside of the furnace into a first chamber and a second chamber; the burner is provided in the second chamber; an air outlet of the furnace communicates with the first chamber; the air guiding device has a passageway communicating the first chamber and the second chamber, wherein a width of the passageway gradually narrows from the second chamber to the first chamber. Whereby, the hot air generated while the burner is burning gas enters the first chamber from the second chamber through the air guiding device, and then can be smoothly exhausted to outside.

10 Claims, 6 Drawing Sheets

GAS FIREPLACE

The current application claims a foreign priority to application number 104122334 filed on Jul. 9, 2015 in Taiwan.

BACKGROUND OF THE INVENTION

1. Technical Field

The present invention relates generally to a gas fireplace, and more particularly to a gas fireplace which has an air guiding device in a furnace thereof.

2. Description of Related Art

As shown in FIG. 1, a conventional gas fireplace includes a furnace 1 and a burner 2. The furnace 1 has an air outlet 1*a*, which is located at a top thereof, and an air inlet 1*b*, wherein the air outlet 1*a* communicates with the furnace 1 at a top thereof, and the air inlet 1*b* communicates with the furnace 1 at a bottom thereof through an air channel 1*c* located at a rear side of the furnace 1. The furnace 1 is open at a front side thereof, where a toughened glass 3 is provided. The burner 2 is installed at the bottom of the furnace 1, and the burner burns gas to produce flames, which can be seen through the toughened glass 3 from outside.

While the burner 2 is burning gas, the generated hot air gradually rises to the top of the furnace 1, and then the hot air is exhausted through the air outlet. However, the air outlet 1*b* only allows part of the hot air to pass therethrough; most of the hot air would bump into an inner wall of the top of the furnace 1, and then flow downwardly, which generates a turbulent air flow inside the furnace 1. Such turbulent air flow may further hinder the exhaust of the hot air. As a result, the temperature of an outer surface of the toughened glass 3 may become so high that it may cause scalds.

BRIEF SUMMARY OF THE INVENTION

In view of the above, the primary objective of the present invention is to provide a gas fireplace, which can effectively exhaust hot air generated by burning gas out from the inside of the furnace.

The present invention provides a gas fireplace, which includes a furnace, a burner, and an air guiding device. The furnace has an air outlet communicating with an inside thereof. The burner is provided in the furnace. The air guiding device is provided in the furnace, and between the air outlet and the burner, wherein the air guiding device divides the inside of the furnace into a first chamber and a second chamber; the air outlet communicates with the first chamber; the burner is provided in the second chamber; the air guiding device has a passageway communicating the first chamber and the second chamber, wherein a width the passageway gradually narrows from the second chamber to the first chamber.

In one embodiment, the gas fireplace further includes a dividing member, which is connected to an inner wall of the furnace and in the second chamber, wherein the dividing member has an opening; the burner is located below the dividing member, and corresponds to the opening; the furnace has an air inlet, which communicates with a space below the dividing member.

With the aforementioned design, the hot air generated while the burner is burning gas can be effectively guided and exhausted through the air guiding device, which prevents heat from accumulating in the furnace.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
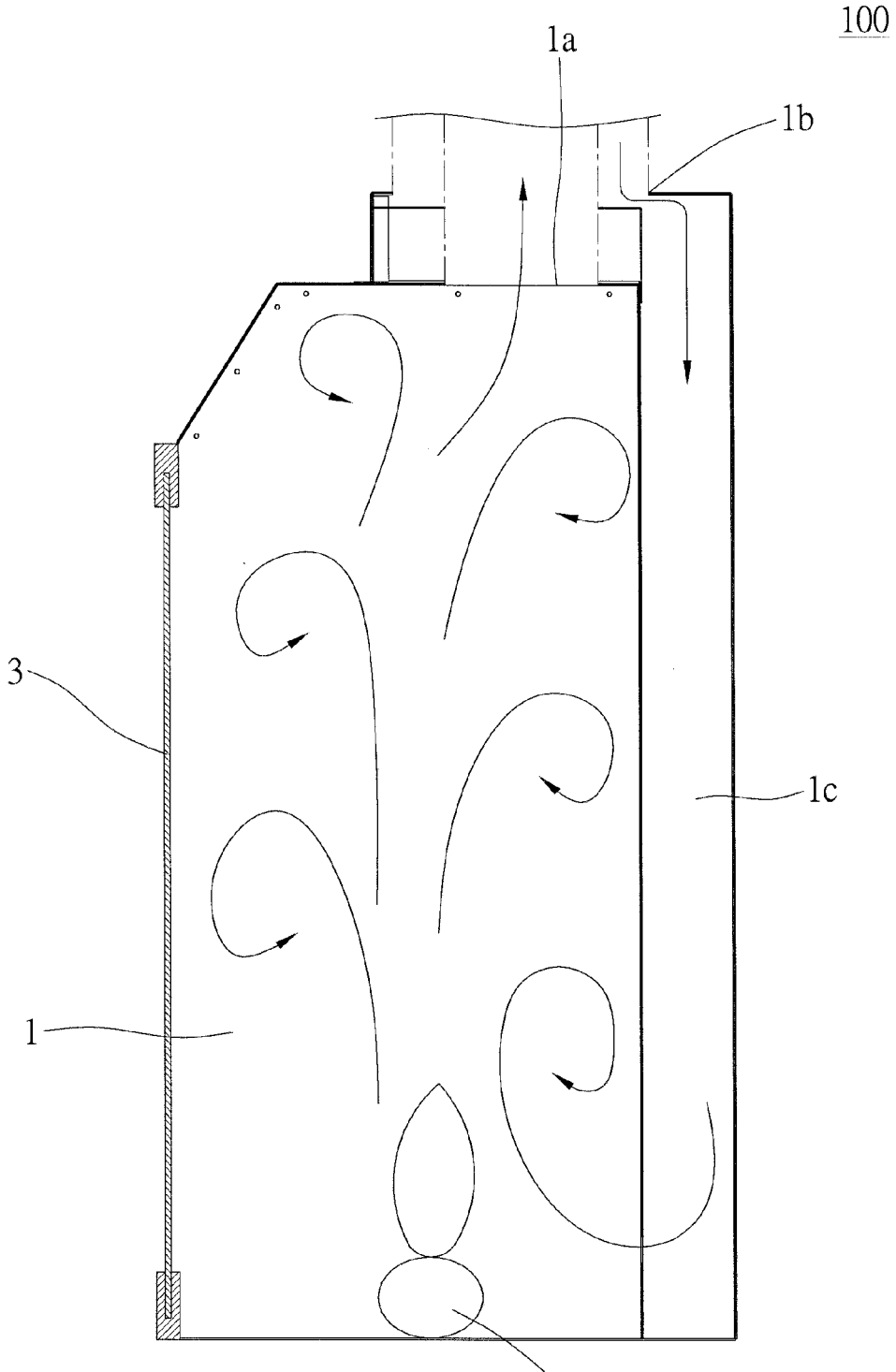
FIG. 1 (PRIOR ART)
FIG. 1 is a sectional view of a conventional gas fireplace.
Figure 2:
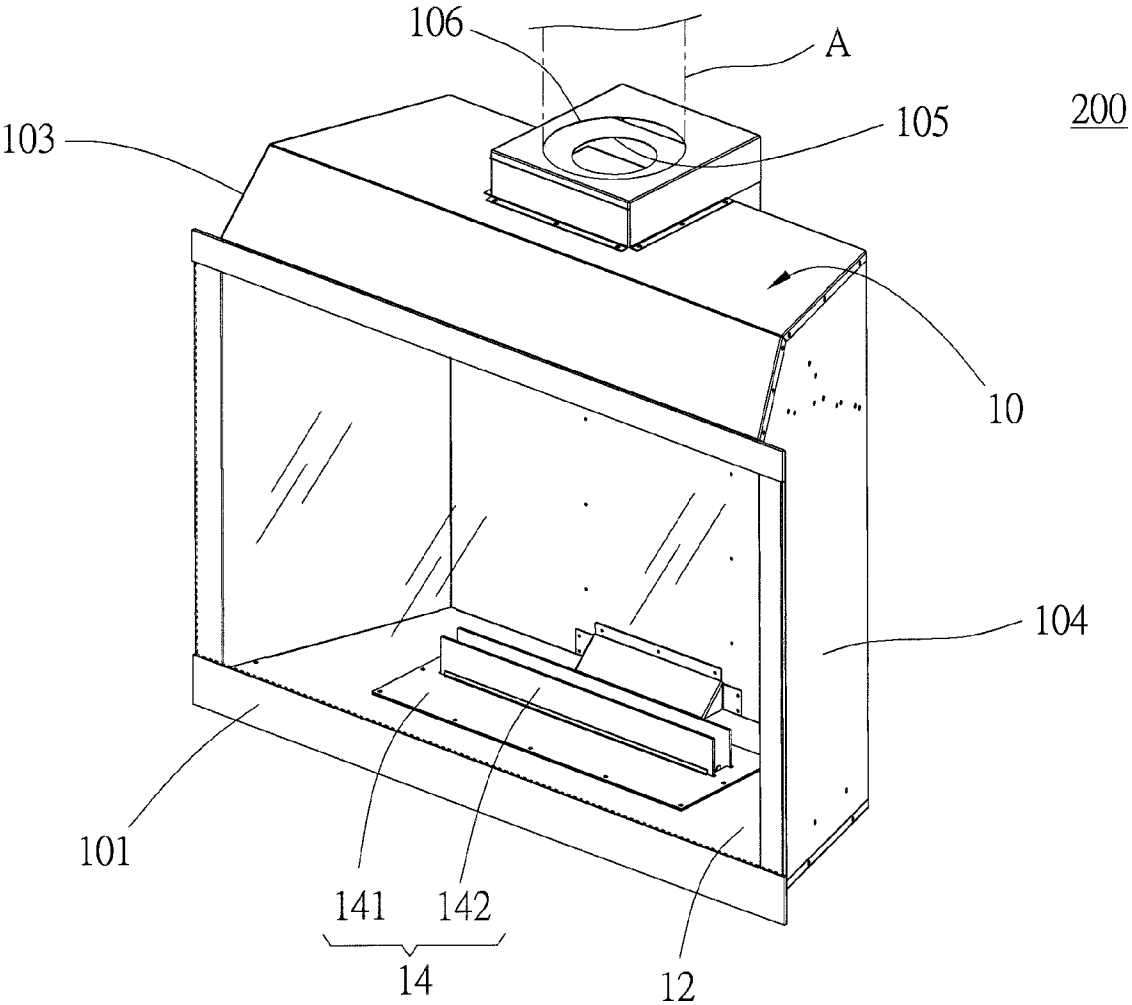
FIG. 2 is a perspective view of a first preferred embodiment of the present invention.
Figure 3:
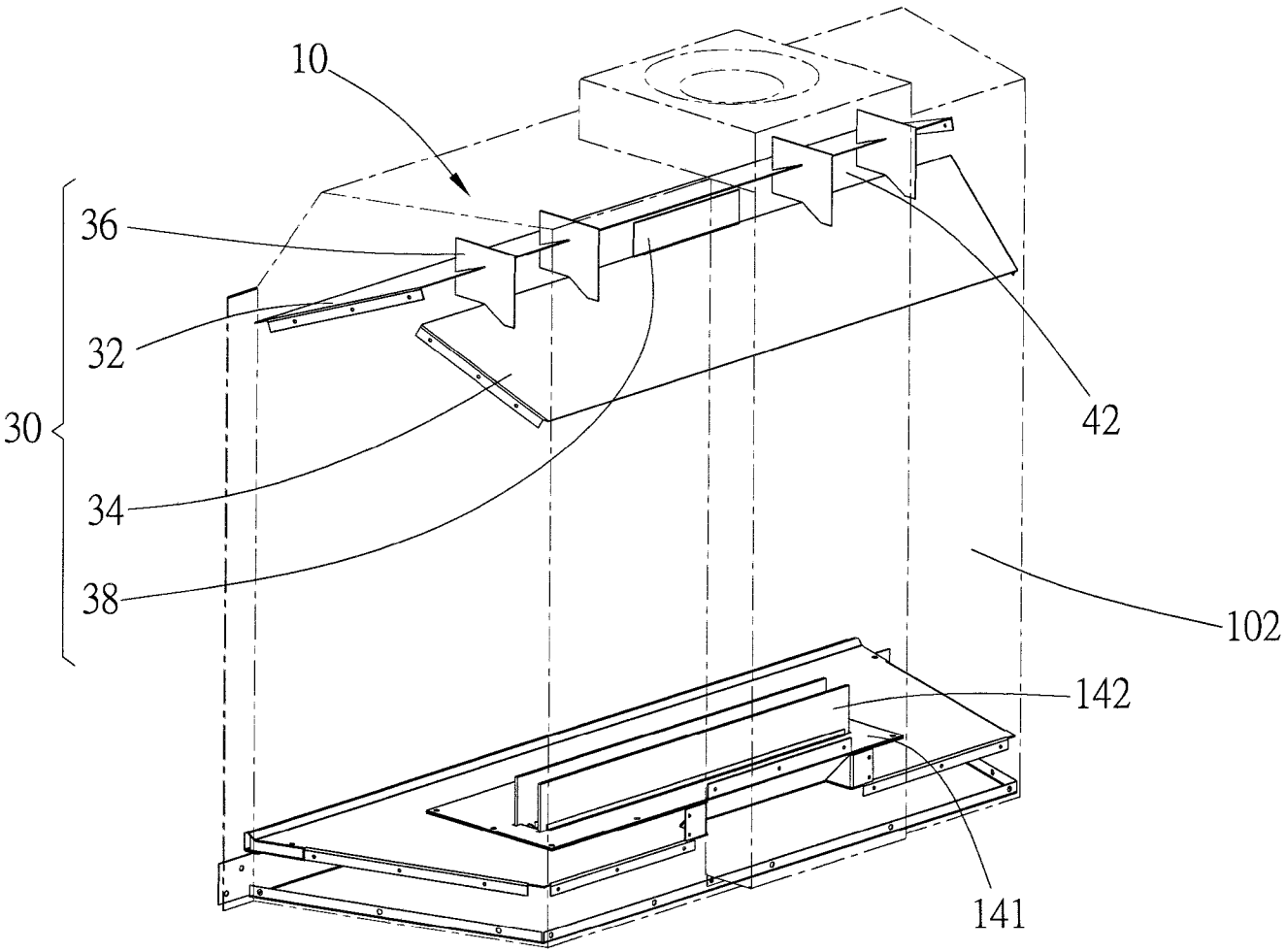
FIG. 3 is a schematic view, showing the location of the air guiding device relative to the furnace.
Figure 4:
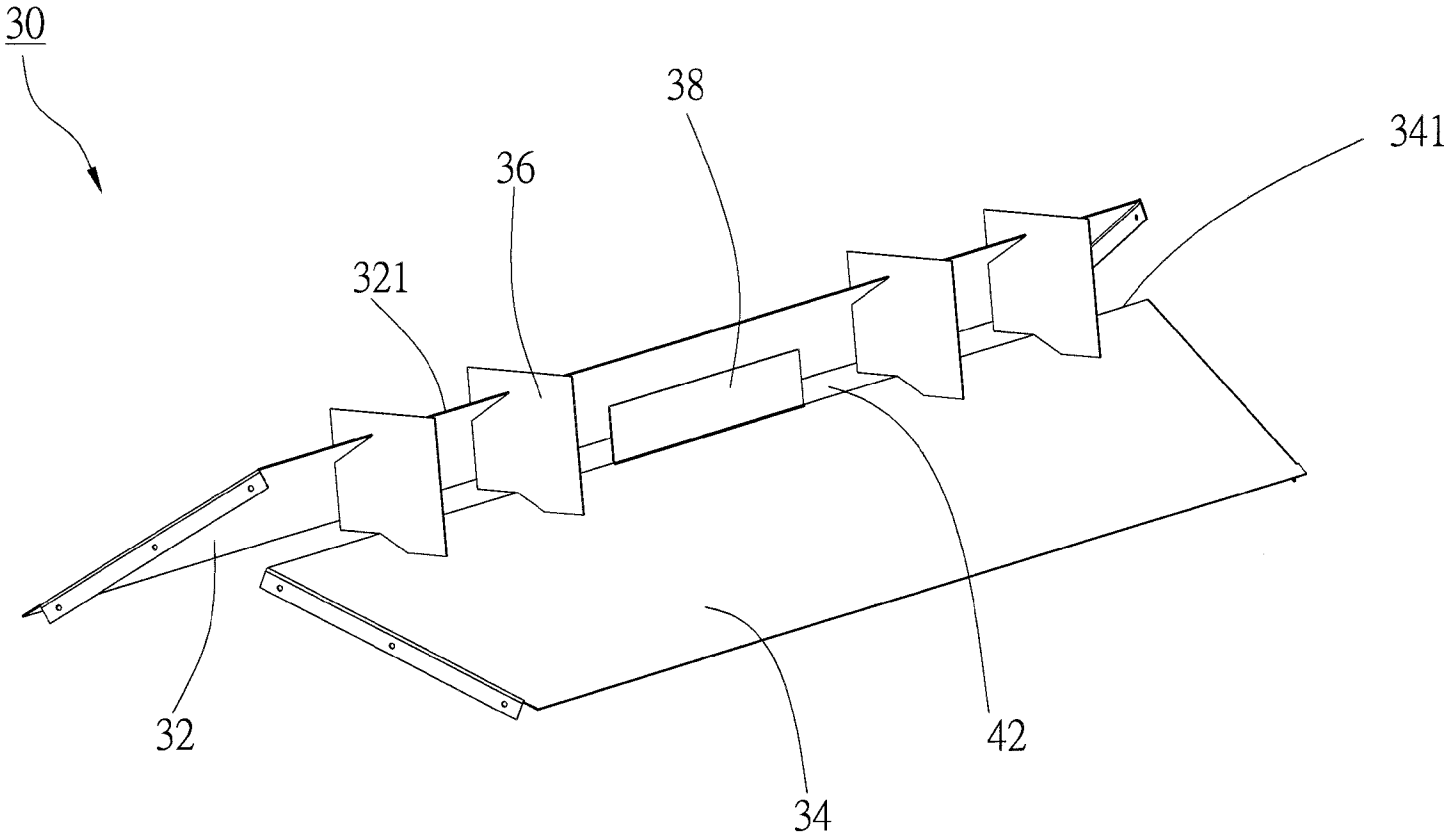
FIG. 4 is a perspective view of the air guiding device.

As shown in FIG. 2 to FIG. 6, a gas fireplace 200 of the preferred embodiment of the present invention includes a furnace 10, a burner 20, and an air guiding device 30.

The furnace 10 has a front side 101, a rear side 102, a left side 103, and a right side 104. An inner width of the furnace 10 gradually narrows from the rear side 102 to the front side 101. The front side 101 of the furnace 10 is open, which is sealed and covered by a toughened glass 12. The flames in the furnace 10 can be seen through the toughened glass 12 from outside.

The furnace 10 has an air outlet 105 and an air inlet 106 provided on a top thereof, wherein the air outlet 105 communicates with the inside of the furnace 10. The air inlet 106 communicates with the furnace 10 at a bottom thereof through an air channel 107 located at the rear side 102 of the furnace 10. The air outlet 105 and the air inlet 106 communicate with a pipe A, which is composed by an inner tube A1 and an outer tube A2, wherein the inner tube A1 communicates with the air outlet 105, and the outer tube A2 communicates with the air inlet 106.

The furnace 10 further has a dividing member 14 provided therein, wherein the dividing member 14 includes a dividing plate 141 and two vertical plates 142. The dividing plate 141 is connected to an inner wall of the furnace 10. The dividing plate 141 has an opening 143, wherein the vertical plates 142 are provided at where the opening 143 is. The air channel 107 communicates with a space below the dividing plate 141.

The burner 20 is provided at the bottom of the furnace 10 below the dividing plate 141, and corresponds to the opening 143, wherein the burner 20 is used to burn gas. The burner 20 is a long component, which extends from the left side 103 of the furnace 10 to the right side 104 of the furnace 10. The flames produced by the burner 20 surpass the dividing plate 141 through a space between the vertical plates 142.

The air guiding device 30 is connected to the inner wall of the furnace 10, and is located between the air outlet 105 and the burner 20. The air guiding device 30 divides the furnace 10 into a first chamber S1 and a second chamber S2, wherein the first chamber S1 communicates with the air outlet 105, and the dividing member 14 and the burner 20 are located in the second chamber S2. The air guiding device 30 includes a first guide plate 32, a second guide plate 34, a plurality of spacers 36, and a baffle 38. The first guide plate 32 tilts from a center of the furnace 10 toward the front side 101; the second guide plate 34 tilts from the center of the furnace 10 as well, but toward the rear side 102.

The first guide plate 32 has a first top edge 321 and a first guide surface 322, while the second guide plate 34 has a second top edge 341 and a second guide surface 342. The first and the second top edges 321, 341 are separated by a distance, and are parallel to each other. The first and the second top edges 321, 341 extends in a direction parallel to the burner 20, wherein the first top edge 321 is higher than the second top edge 341. The guide surfaces 322, 342 face the second chamber S2, and a passageway 40 is formed therebetween, which communicates the first chamber S1 and the second chamber S2. A width of the passageway 40 between the front side 101 and the rear side 102 gradually decreases from bottom to top, wherein a gap 42 is formed between the first and the second top edges 321, 341 to communicate the passageway 40 and the first chamber S1. The gap 42 is directly above the burner 20, and has a long-axis direction parallel to an extending direction of the burner 20, wherein a width of the gap 42 in the long-axis direction thereof is greater than a length of the burner 20 in the extending direction thereof.

The spacers 36 are separately arranged at the gap 42, wherein each of spacers 36 is respectively connected to the first guide plate 32 and the second guide plate 34, and is perpendicular to the guide surfaces 322, 342. The baffle 38 is fixed at the second top edge 341 of the second guide plate 34, and is located between two of the spacers 36 which are closest to the air outlet 105, wherein the baffle 38 corresponds to the air outlet 105. The distances between each of these two spacers 36, which are closet to the air outlet 105, and the baffle 38 are identical, i.e., said two spacers 36 are symmetrically arranged at opposite sides of the baffle 38.

Figure 5:
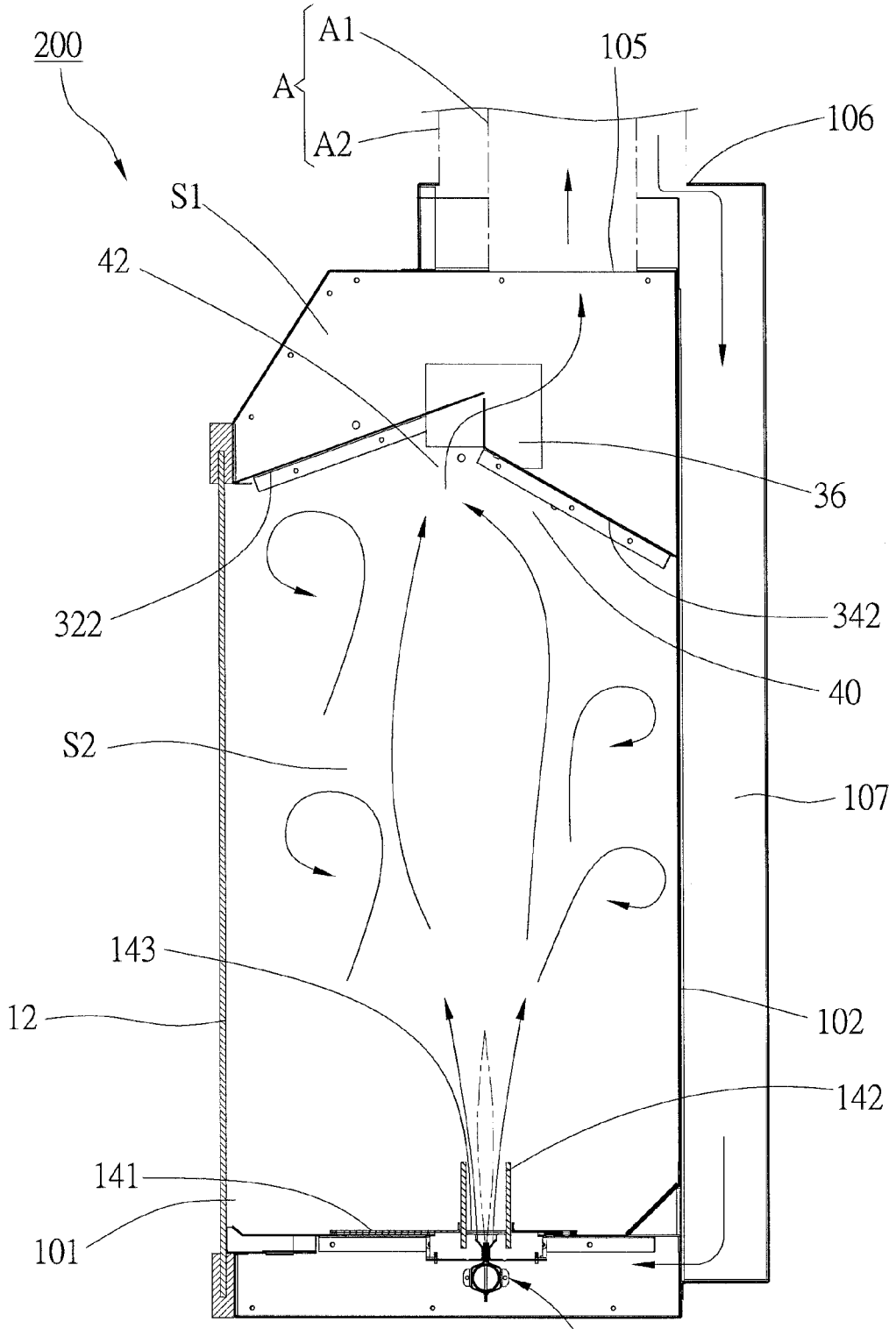
FIG. 5 is a sectional view, showing the flowing of air while burning gas.
Figure 6:
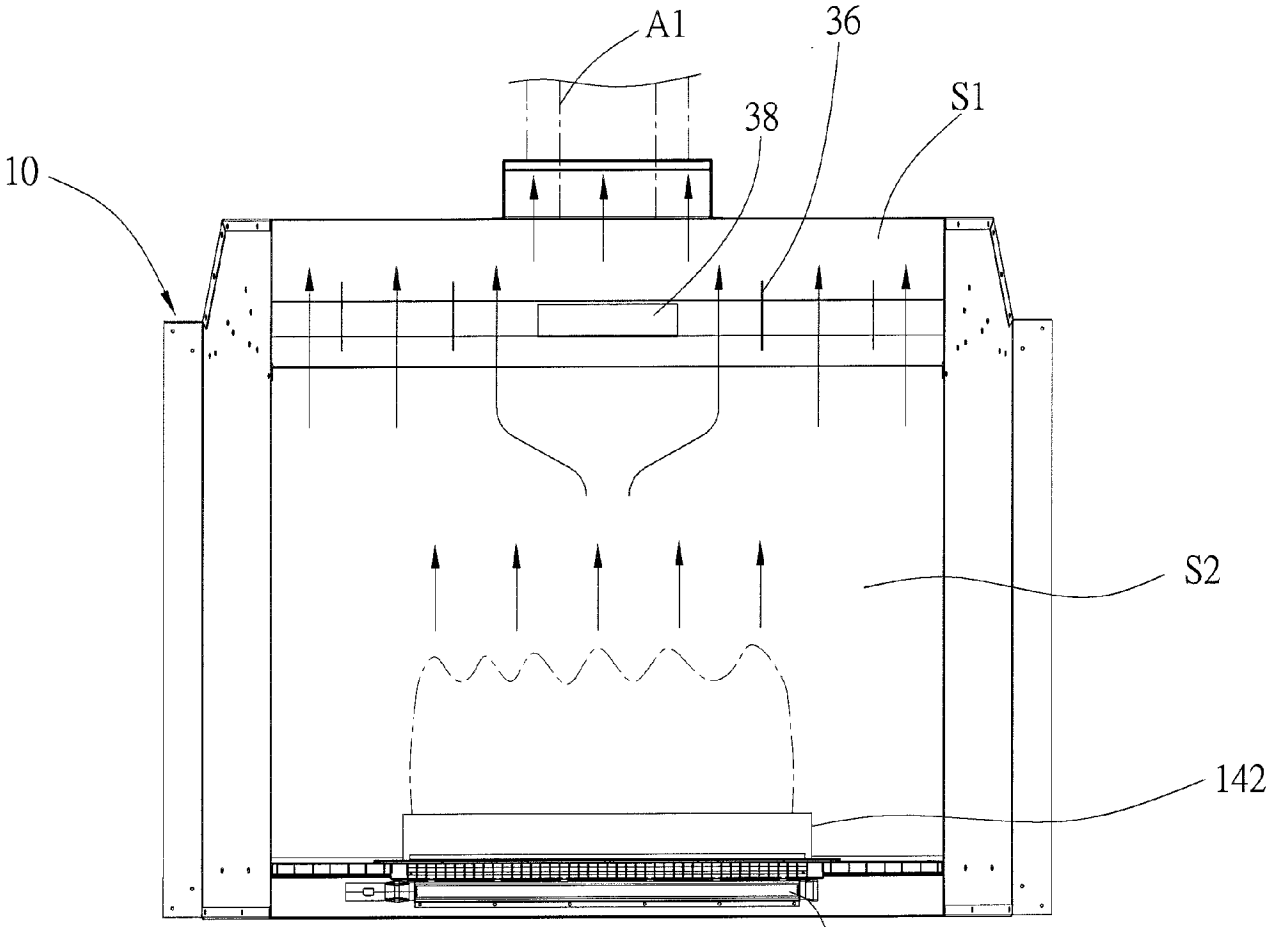
FIG. 6 is a sectional view, showing the flowing of air while burning gas.

As shown in FIG. 5 and FIG. 6, while the burner 20 is burning gas, the generated hot air current rises from the second chamber S2, and flows into the first chamber S1 along the guide surfaces 322, 342 and through the gap 42; after that, the hot air current is exhausted through the air outlet 105. Since the widths of the guide surfaces 322, 342 gradually narrow from bottom to top, the flowing speed of the hot air current could be reduced as a result, and therefore the hot air could enter the first chamber S1 more smoothly, which reduces the chance of generating a turbulent air flow inside the second chamber S2, and also prevents the hot air from staying in the second chamber S2. In this way, the temperature inside the second chamber S2 would not become too high. Furthermore, after the hot air enters the first chamber S1, it could be exhausted out through the air outlet 105 more easily due to the slow speed of the hot air current inside the first chamber S1.

The combustion air which enters into the furnace 10 through the air inlet 106 is provided below the dividing plate 141, and therefore it would not affect the air flow above the dividing plate 141. In addition, the baffle 38 of the air guiding device 30 is located corresponding to the air outlet 105 to prevent the rising hot air from being too concentrated after passing through the passageway 40. In other words, with the baffle 38, the hot air current passes through the spaces between the spacers 36 in a distributed way, and this lowers the chance of generating the turbulent air flow. The spacers 36 are symmetrically arranged with the baffle 38 at the center, which makes the air flow enter the first chamber S1 evenly through both sides of the baffle 38.

In summary, the air guiding device 30 of the gas fireplace 200 provided in the present invention is capable of guiding the hot air, which helps to smoothly exhaust the hot air in the furnace 10 to outside. As a result, less heat would be accumulated in the second chamber S2, and the temperature of the toughened glass 12 could be lowered more effectively than the situation for a conventional gas fireplace.

It must be pointed out that the embodiments described above are only some preferred embodiments of the present invention. All equivalent structures which employ the concepts disclosed in this specification and the appended claims should fall within the scope of the present invention.

What is claimed is:

1. A gas fireplace, comprising:

a furnace, which has an air outlet communicating with an inside thereof;

a burner provided in the furnace; and an air guiding device provided in the furnace, and between the air outlet and the burner, wherein the air guiding device divides the inside of the furnace into a first chamber and a second chamber; the air outlet communicates with the first chamber; the burner is provided in the second chamber;

the air guiding device including:

a first guide plate, having a first guiding surface;

a second guiding plate, having a second guiding surface, wherein the first guiding surface and the second guiding surface both tilt downward respectively, and a passageway is formed therebetween;

the passageway communicates with the first chamber and with the second chamber, and the passageway gradually narrows from the second chamber to the first chamber; and at least two spacers, each of the at least two spacers is connected to at least one of the first guide plate and the second guide plate, and is perpendicular to each of the guide surfaces.

2. The gas fireplace of claim 1, wherein the first guide plate has a first top edge, and the second guide plate has a second top edge; a gap is formed between the first top edge and the second top edge, wherein the gap communicates the passageway and the first chamber; the first top edge is higher than the second top edge.

3. The gas fireplace of claim 1, further comprising a baffle located between the at least two spacers and corresponding to the air outlet.

4. The gas fireplace of claim 3, wherein the at least two spacers are symmetrically arranged with the baffle at a center thereof.

5. The gas fireplace of claim 1, wherein the furnace has a left side and a right side, and the burner extends from the left side of the furnace toward the right side of the furnace; the air guiding device has a gap communicating the passageway and the first chamber, wherein the gap has a long-axis direction, which is parallel to an extending direction of the burner.

6. The gas fireplace of claim 5, wherein a width of the gap in the long-axis direction thereof is greater than a length of the burner in the extending direction thereof.

7. The gas fireplace of claim 1, wherein the passageway has a gap, which corresponds to the first chamber, and is directly above the burner.

8. The gas fireplace of claim 1, further comprising a dividing member, which is connected to an inner wall of the furnace and in the second chamber, wherein the dividing member has an opening; the burner is located below the dividing member, and corresponds to the opening; the furnace has an air inlet, which communicates with a space below the dividing member.

9. The gas fireplace of claim 6, wherein the dividing member comprises a dividing plate and two vertical plates;

the opening is formed on the dividing plate; the vertical plates are respectively provided at the opening; the burner is located below the dividing plate.

10. The gas fireplace of claim 2, wherein the first top edge of the first guiding plate and the second top edge of the second guiding plate overlap with each other in a height direction of the furnace.

* * * * *